US010566127B2

(12) United States Patent
Theisen et al.

(10) Patent No.: US 10,566,127 B2
(45) Date of Patent: Feb. 18, 2020

(54) FE—SI—B—C-BASED AMORPHOUS ALLOY RIBBON AND TRANSFORMER CORE FORMED THEREBY

(71) Applicants: METGLAS, INC., Conway, SC (US); HITACHI METALS, LTD., Tokyo (JP)

(72) Inventors: Eric Theisen, Conway, SC (US); Yuichi Ogawa, Yasugi (JP); Daichi Azuma, Tokyo (JP)

(73) Assignees: HITACHI METALS, LTD., Tokyo (JP); METGLAS, INC., Conway, SC (US)

( * ) Notice: Subject to any disclaimer, the term of this patent is extended or adjusted under 35 U.S.C. 154(b) by 260 days.

(21) Appl. No.: 15/534,381

(22) PCT Filed: Dec. 8, 2015

(86) PCT No.: PCT/US2015/064461

§ 371 (c)(1),
(2) Date: Jun. 8, 2017

(87) PCT Pub. No.: WO2016/094385

PCT Pub. Date: Jun. 16, 2016

(65) Prior Publication Data

US 2017/0365392 A1 Dec. 21, 2017

Related U.S. Application Data

(63) Continuation of application No. 14/566,907, filed on Dec. 11, 2014.

(51) Int. Cl.
*H01F 27/25* (2006.01)
*H01F 1/153* (2006.01)
(Continued)

(52) U.S. Cl.
CPC ..... *H01F 27/25* (2013.01); *C22C 38/002* (2013.01); *C22C 38/02* (2013.01); *C22C 45/00* (2013.01);
(Continued)

(58) Field of Classification Search
None
See application file for complete search history.

(56) References Cited

U.S. PATENT DOCUMENTS 5,593,513 A * 1/1997 Ramanan ..... C22C 45/02 148/304
5,593,518 A * 1/1997 Ramanan ..... C22C 45/02 148/304
(Continued)

FOREIGN PATENT DOCUMENTS

JP 9-143640 6/1997
JP 3208051 7/2001
(Continued)

OTHER PUBLICATIONS

"Amorphous Cores for Distribution Transformers," Enpay Transformer Components, Dec. 31, 2011, retrieved from the internet: http://www.travek.elektrozavod.ru/sites/default/files/images/production/enpay/Amorphous%20Core%20Catalogue.pdf, XP55461162, 8 pgs.
(Continued)

*Primary Examiner* — Kevin M Bernatz

(57) ABSTRACT

An Fe—Si—B—C-based amorphous alloy ribbon as thick as 20-30 μm having a composition comprising 80.0-80.7 atomic % of Fe, 6.1-7.99 atomic % of Si, and 11.5-13.2 atomic % of B, the total amount of Fe, Si and B being 100 atomic %, and further comprising 0.2-0.45 atomic % of C per 100 atomic % of the total amount of Fe, Si and B, except for inevitable impurities has a stress relief degree of 92% or more.

10 Claims, 8 Drawing Sheets

(51) Int. Cl.

| | |
|---|---|
| ***C22C 38/02*** | (2006.01) |
| ***C22C 38/00*** | (2006.01) |
| ***C22C 45/02*** | (2006.01) |
| ***C22C 45/00*** | (2006.01) |

(52) U.S. Cl.
CPC ..... *C22C 45/02* (2013.01); *H01F 1/15308* (2013.01)

(56) References Cited

U.S. PATENT DOCUMENTS

| | | | | |
|---|---|---|---|---|
| 5,833,769 | A | 11/1998 | Kogiku et al. | |
| 5,871,593 | A * | 2/1999 | Fish | C22C 45/02 148/304 |
| 5,958,153 | A * | 9/1999 | Sakamoto | H01F 27/24 148/304 |
| 6,471,789 | B1 | 10/2002 | Ames et al. | |
| 7,744,703 | B2 | 6/2010 | Imai et al. | |
| 9,881,735 | B2 * | 1/2018 | Azuma | H01F 1/15308 |
| 9,978,497 | B2 * | 5/2018 | Azuma | B23K 26/082 |
| 2003/0107523 | A1 * | 6/2003 | Yahata | G06K 19/07749 343/787 |
| 2006/0000524 | A1 * | 1/2006 | Ogawa | H01F 1/15308 148/304 |
| 2009/0242082 | A1 | 10/2009 | Imai et al. | |
| 2012/0048428 | A1 | 3/2012 | Ogawa et al. | |
| 2012/0049992 | A1 | 3/2012 | Azuma et al. | |
| 2012/0062351 | A1 | 3/2012 | Theisen et al. | |
| 2015/0050510 | A1 * | 2/2015 | Motegi | C22C 45/02 428/544 |

FOREIGN PATENT DOCUMENTS

| | | | | |
|---|---|---|---|---|
| JP | 2006-312777 | | 11/2006 | |
| JP | 2007-281314 | A | 10/2007 | |
| JP | 2009-7639 | | 1/2009 | |
| JP | 2009-83856 | | 4/2009 | |
| WO | WO 2013/137118 | A1 | 9/2013 | |
| WO | WO-2013137118 | A1 * | 9/2013 | C22C 45/02 |

OTHER PUBLICATIONS

Extended European Search Report dated Apr. 5, 2018, in corresponding European Patent Application No. 15866555.4, 9 pgs.

PCT Written Opinion of the International Searching Authority dated Feb. 11, 2016 in co-pending International Patent Application No. PCT/US15/64461.

PCT International Search Report dated Feb. 11, 2016 in co-pending International Patent Application No. PCT/US15/64461.

Notice of Abandonment dated Nov. 25, 2016 in related U.S. Appl. No. 14/566,907.

U.S. Office Action dated Apr. 21, 2016 in related U.S. Appl. No. 14/566,907.

International Preliminary Report on Patentability dated Jun. 22, 2017 in corresponding International Patent Application No. PCT/US2015/064461.

Notice of Reason for Refusal dated Oct. 29, 2019 in related Japanese Patent Application No. 2017-527709 (6 pages).

* cited by examiner

FE—SI—B—C-BASED AMORPHOUS ALLOY RIBBON AND TRANSFORMER CORE FORMED THEREBY

CROSS-REFERENCE TO RELATED APPLICATIONS

This application is a U.S. National Stage Application, which claims the benefit under 35 U.S.C. § 371 of PCT International Patent Application No. PCT/US2015/064461, filed Dec. 8, 2015, which in turn claims priority benefit to U.S. patent application Ser. No. 14/566,907, filed Dec. 11, 2014.

FIELD OF THE INVENTION

The present invention relates to an Fe—Si—B—C-based amorphous alloy ribbon, and a transformer core formed thereby.

BACKGROUND OF THE INVENTION

Iron-based amorphous alloy ribbons exhibit excellent soft magnetic properties including low magnetic loss under AC excitation, finding their applications in energy-efficient magnetic devices such as transformers, motors, generators, etc. In these devices, ferromagnetic materials with high saturation magnetization and thermal stability with small core loss and exciting power are preferred. Fe—B—Si-based amorphous alloys meet these requirements. However, higher saturation magnetization is required for these amorphous alloys to reduce the size of transformers, etc.

U.S. Pat. No. 6,471,789 discloses a metal alloy strip having a composition represented by the formula of $Fe_aB_bSi_c$, wherein a, b and c are atomic percentages ranging from about 79 to less than 80, greater than 10 and up to 16, and 5 to 10, respectively, with the sum of a, b, and c being 100, and b being greater than c, the alloy strip having a core loss of less than about 0.22 W/kg at 60 Hz and an induction value within 1.0-1.5 Tesla, and the alloy having effective amounts of boron and silicon such that the strip is at least singularly ductile and is at least 75% in an amorphous phase. Though this metal alloy strip has high magnetic induction with small core loss and exciting power, our research has revealed that when bent with a small radius of curvature to form transformers, it likely has large internal stress, which cannot sufficiently be removed even by a heat treatment, resulting in a relatively large core loss and exciting power.

JP 9-143640 A discloses a wide, amorphous alloy ribbon used for power transformer cores having a composition represented by the chemical formula of $Fe_aB_bSi_cC_d$, wherein a, b, c and d are numbers (atomic %) meeting $78.5 \le a \le 81$, $9.5 \le b \le 13$, $8 \le c \le 12.5$, and $0.4 \le d \le 1.5$, the ribbon being cast in an atmosphere containing 40% or more by volume of a carbon dioxide gas by a single-roll, liquid-quenching method, the as-cast ribbon having a width of 70 mm or more, and a roll-contacting surface of the as-cast ribbon having a centerline-averaged roughness Ra of 0.7 μm or less. JP 9-143640 A describes that this wide, amorphous alloy ribbon has excellent magnetic properties, thermal stability, workability, and productivity, suitable for power transformer cores.

However, because 8-12.5 atomic % of Si is contained in this wide, amorphous alloy ribbon of JP 9-143640 A, it has been found that relatively large internal stress remains in a core formed by laminating and bending this amorphous alloy ribbon, even after a heat treatment. In addition, though FIGS. 1-9 in JP 9-143640 A show wider ranges of Fe, B, Si and C than those recited in the claims, the specification of JP 9-143640 A exhibits only examples of Fe—B—Si—C amorphous alloys with 79 atomic % of Fe. The chemical compositions specifically shown in JP 9-143640 A are limited to $Fe_{79}B_{11.5}Si_9C_{0.5}$ (FIG. 1), $Fe_{79}B_{10.5}Si_{10.5-X}C_X$ (FIGS. 2-4), $Fe_{79}B_{20.5-y}Si_yC_{0.5}$ (FIG. 5), $Fe_ZB_{10.5}Si_{89-Z}C_{0.5}$ (FIGS. 6 and 7), and $Fe_{79}B_{20.5-y}Si_yC_{0.5}$ (FIGS. 8 and 9). Thus, the amount of Fe is limited to 79 atomic % when the amount of Si is 9 atomic % (FIG. 1), when the amount of C is changed from 2 atomic % to 5 atomic % (FIGS. 2-4), when the amount of Si is changed from 6 atomic % to 12 atomic % (FIG. 5), or when the amount of Si is changed from 8 atomic % to 14 atomic % (FIGS. 8 and 9), and the amount of B is limited to 10.5 atomic % when the amount of Fe is changed from 77 atomic % to 83 atomic % (FIGS. 6 and 7).

US 2012/0062351 A1 discloses a ferromagnetic, amorphous alloy ribbon having a composition represented by $Fe_aSi_bB_cC_d$, wherein $80.5 \le a \le 83$ atomic %, $0.5 \le b \le 6$ atomic %, $12 \le c \le 16.5$ atomic %, $0.01 \le d \le 1$ atomic %, with a+b+c+d=100, and incidental impurities; the alloy ribbon being cast from a molten alloy with a surface tension of greater than or equal to 1.1 N/m on a chill body surface; the ribbon having protrusions on the surface facing the chill body surface; the protrusions being measured in terms of height and their number; the protrusion height exceeding 3 μm and less than four times the ribbon thickness; and the number of protrusions being less than 10 within 1.5 in of the ribbon length; and the ribbon in its annealed straight strip form having a saturation magnetic induction exceeding 1.60 T and exhibiting a magnetic core loss of less than 0.14 W/kg when measured at 60 Hz and at 1.3 T induction level. However, our research has revealed that a transformer core formed by laminating and bending this ferromagnetic, amorphous alloy ribbon with a small radius of curvature likely has large internal stress, which cannot sufficiently be removed even by a heat treatment.

WO 2013/137118 A1 discloses an amorphous alloy ribbon comprising Fe, Si, B, C and inevitable impurities; the amount of Si being 8.5-9.5 atomic %, and the amount of B being 10.0-12.0 atomic %, when the total amount of Fe, Si and B is 100 atomic %; the amount of C being 0.2-0.6 atomic %, per 100 atomic % of the total amount of Fe, Si and B; the ribbon having a thickness of 10-40 μm, and a width of 100-300 mm. WO 2013/137118 A1 describes that this amorphous alloy ribbon has a high space factor and magnetic flux density with suppressed brittleness. However, our research has revealed that a transformer core formed by laminating and bending this amorphous alloy ribbon with a small radius of curvature likely has large internal stress, which cannot sufficiently be removed even by a heat treatment.

OBJECT OF THE INVENTION

Accordingly, an object of the present invention is to provide an Fe—Si—B—C-based amorphous alloy ribbon having high saturation magnetization with small core loss and exciting power, which can be laminated and bent with a small radius of curvature to provide a transformer core, whose internal stress can be sufficiently removed by a heat treatment.

Another object of the present invention is to provide a transformer core formed by such an Fe—Si—B—C-based amorphous alloy ribbon, which is operable with low core loss and exciting power.

SUMMARY OF THE INVENTION

Thus, the Fe—Si—B—C-based amorphous alloy ribbon of the present invention has a composition comprising 80.0-80.7 atomic % of Fe, 6.1-7.99 atomic % of Si, and 11.5-13.2 atomic % of B, the total amount of Fe, Si and B being 100 atomic %, and further comprising 0.2-0.45 atomic % of C per 100 atomic % of the total amount of Fe, Si and B, except for inevitable impurities.

The Fe—Si—B—C-based amorphous alloy ribbon of the present invention preferably has a stress relief degree of 92% or more.

The Fe—Si—B—C-based amorphous alloy ribbon of the present invention is as thick as preferably 20-30 μm, more preferably 22-27 μm.

The Fe—Si—B—C-based amorphous alloy ribbon of the present invention preferably has a width of 100 mm or more.

The transformer core of the present invention is formed by a laminate of the above Fe—Si—B—C-based amorphous alloy ribbon.

The transformer core of the present invention preferably has curved corners each having a radius of curvature of 2-10 mm.

The transformer core of the present invention preferably has core loss of less than 0.20 W/kg at 50 Hz and 1.3 T.

BRIEF DESCRIPTION OF THE DRAWINGS

FIG. 2(*b*) is a side view showing the transformer core of FIG. 2(*a*).

FIG. 4(*b*) is a plan view showing test pieces for measuring the number of brittle fracture.

FIG. 4(*c*) is a partial schematic view showing a longitudinal tearing line with a step due to fracture.

FIG. 5(*b*) is a graph showing the relation between stress relief degree and the thickness of the amorphous alloy ribbon in Example 2.

FIG. 5(*c*) is a graph showing the relation between stress relief degree and the thickness of the amorphous alloy ribbon in Example 3.

FIG. 5(*d*) is a graph showing the relation between stress relief degree and the thickness of the amorphous alloy ribbon in Comparative Example 3.

FIG. 6(*b*) is a graph showing the relation between the number of brittle fracture and the thickness of the amorphous alloy ribbon in Example 1.

FIG. 6(*c*) is a graph showing the relation between the number of brittle fracture and the thickness of the amorphous alloy ribbon in Example 2.

FIG. 6(*d*) is a graph showing the relation between the number of brittle fracture and the thickness of the amorphous alloy ribbon in Example 3.

FIG. 6(*e*) is a graph showing the relation between the number of brittle fracture and the thickness of the amorphous alloy ribbon in Comparative Example 3.

FIG. 6(*f*) is a graph showing the relation between the number of brittle fracture and the thickness of the amorphous alloy ribbon in Comparative Example 4.

DESCRIPTION OF THE PREFERRED EMBODIMENTS

[I] Fe—Si—B—C-Based Amorphous Alloy Ribbon (A) Composition

Figure 1:
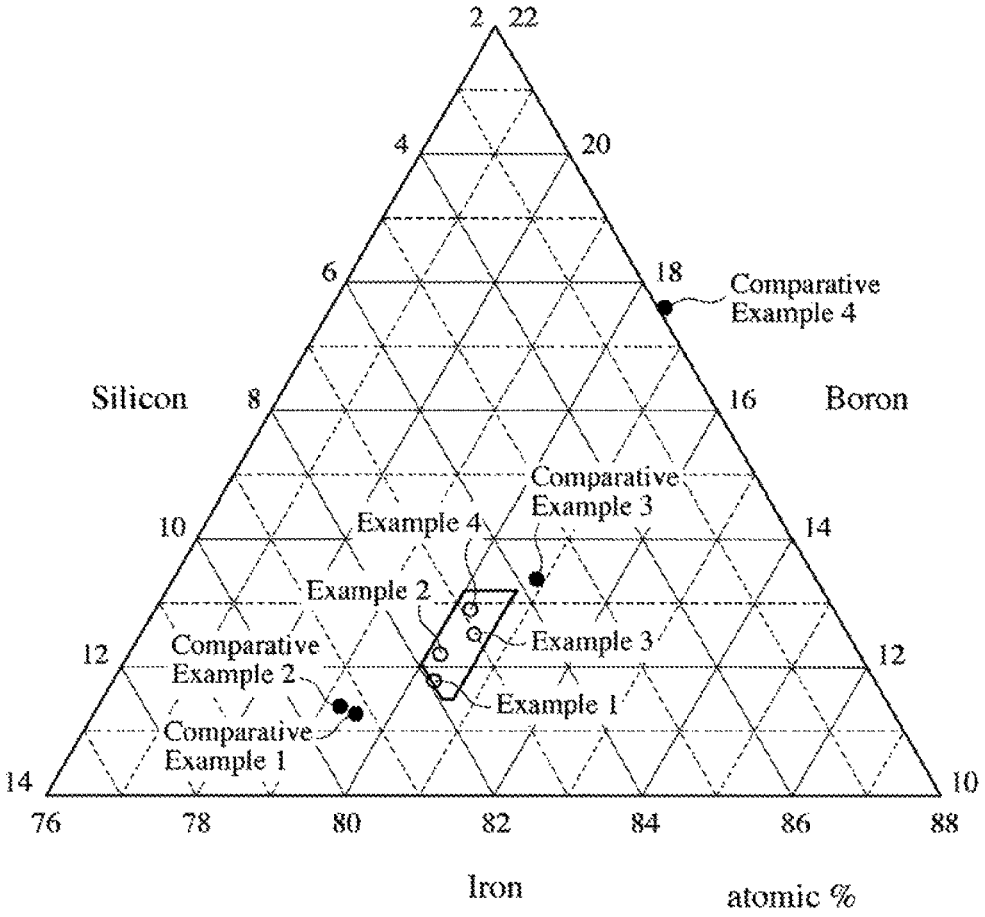
FIG. 1 is a ternary diagram showing the Fe—Si—B composition of the amorphous alloy of the present invention.

The Fe—Si—B—C-based amorphous alloy ribbon of the present invention indispensably comprises Fe, Si, B and C. Among these indispensable elements, Fe, Si and B should meet the conditions shown in FIG. 1, which requires that Fe is 80.0-80.7 atomic %, Si is 6.1-7.99 atomic %, and B is 11.5-13.2 atomic %. C should be 0.2-0.45 atomic % per 100 atomic % of the total amount of Fe, Si and B.

(1) Indispensable Elements (a) Fe: 80.0-80.7 Atomic %

Fe is a main component in the Fe—Si—B—C-based amorphous alloy ribbon of the present invention. In order that the amorphous alloy ribbon has as high a saturation magnetization as possible, the Fe content is preferably as high as possible. However, too much Fe makes it difficult to form an Fe—Si—B—C-based amorphous alloy ribbon. Accordingly, the Fe content is restricted to 80.0-80.7 atomic %. The lower limit of the Fe content is preferably 80.05 atomic %, more preferably 80.1 atomic %. The upper limit of the Fe content is preferably 80.65 atomic %, more preferably 80.6 atomic %.

(b) Si: 6.1-7.99 Atomic %

Si is an element necessary for forming an Fe—Si—B—C-based amorphous alloy ribbon with sufficient saturation magnetization. When Si is less than 6.1 atomic %, it is unstable to produce the Fe—Si—B—C amorphous alloy ribbon. On the other hand, when Si is more than 7.99 atomic %, the resultant Fe—Si—B—C-based, amorphous alloy is too brittle. The lower limit of the Si content is preferably 6.3 atomic %, more preferably 6.5 atomic %, further preferably 6.7 atomic %, most preferably 7.0 atomic %. The upper limit of the Si content is preferably 7.98 atomic %, more preferably 7.97 atomic %.

(c) B: 11.5-13.2 Atomic %

B is an element necessary for making an Fe—Si—B—C-based alloy ribbon amorphous. When B is less than 11.5 atomic %, it is difficult to obtain an Fe—Si—B—C-based amorphous alloy ribbon stably. On the other hand, when B is more than 13.2 atomic %, the resultant Fe—Si—B—C-based amorphous alloy ribbon has a lower stress relief degree. The lower limit of the B content is preferably 11.6 atomic %, more preferably 11.7 atomic %. The upper limit of the B content is preferably 13.0 atomic %, more preferably 12.9 atomic %, most preferably 12.7 atomic %.

(d) C: 0.2-0.45 Atomic %

C is an element necessary for providing an Fe—Si—B—C-based amorphous alloy ribbon with a high stress relief degree. The amount of C is expressed by atomic % per 100 atomic % of the total amount of Fe, Si and B. When C is less than 0.2 atomic %, the resultant Fe—Si—B—C-based amorphous alloy ribbon does not have a high stress relief degree. On the other hand, when C is more than 0.45 atomic %, the resultant Fe—Si—B—C-based amorphous alloy ribbon is too brittle. The lower limit of the C content is preferably 0.25 atomic %, more preferably 0.30 atomic %. The upper limit of the C content is preferably 0.43 atomic %, more preferably 0.42 atomic %.

(2) Inevitable Impurities

The amorphous alloy ribbon may contain impurities such as Mn, Cr, Cu, Al, Mo, Zr, Nb, etc., which come from raw materials. Though the total amount of impurities is preferably as small as possible, it may be up to 1 atomic %, per 100 atomic % of the total amount of Fe, Si and B.

(B) Size (1) Thickness

Figure 2A:
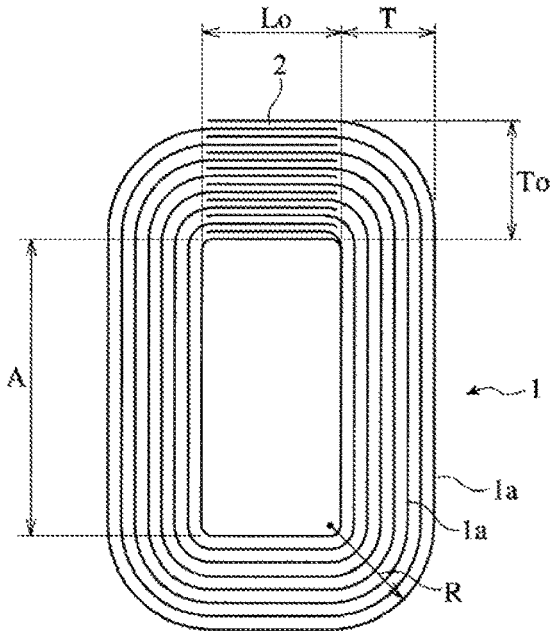
FIG. 2(*a*) is a front view showing a transformer core.
Figure 2B:
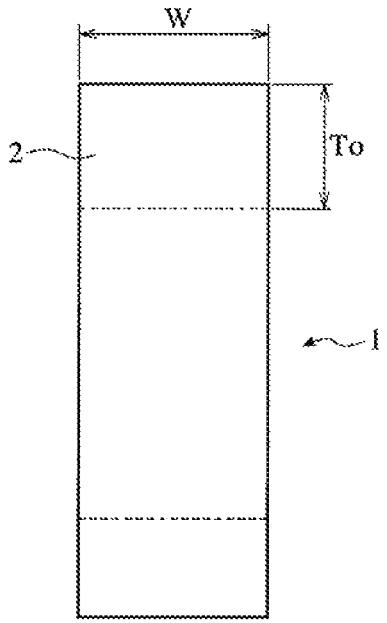

To exhibit high performance when used for transformers, the amorphous alloy ribbon preferably has as large thickness as possible. However, it is more difficult to form a thicker amorphous alloy ribbon by rapid quenching, so that the resultant amorphous alloy ribbon is more brittle. This is particularly true when the alloy ribbon is as wide as 100 mm or more. In the present invention, the Fe—Si—B—C-based amorphous alloy ribbon is preferably as thick as 20-30 μm to have a large space factor when laminated to form a transformer core as shown in FIG. 2. With respect to the thickness of the amorphous alloy ribbon, its upper limit is more preferably 27 μm, and its lower limit is more preferably 22 μm.

(2) Width

Because a wider amorphous alloy ribbon easily provides a large transformer core, the Fe—Si—B—C-based amorphous alloy ribbon is preferably as wide as 120 mm or more. However, because a wider amorphous alloy ribbon is more difficult to produce, the practical upper limit of the width of the Fe—Si—B—C-based amorphous alloy ribbon is 260 mm.

(C) Properties

Because the Fe—Si—B—C-based amorphous alloy ribbon of the present invention is cut to a proper length, and the resultant amorphous alloy ribbon pieces are laminated and bent to form a transformer core as shown in FIGS. 2(*a*) and 2(*b*), the amorphous alloy ribbon pieces are subject to strong internal stress particularly in bent portions. Because the internal stress deteriorates the magnetic properties of the Fe—Si—B—C-based amorphous alloy ribbon, the transformer core is subject to a heat treatment for removing the internal stress. It is thus important that internal stress is sufficiently removed by a heat treatment.

Figure 3:
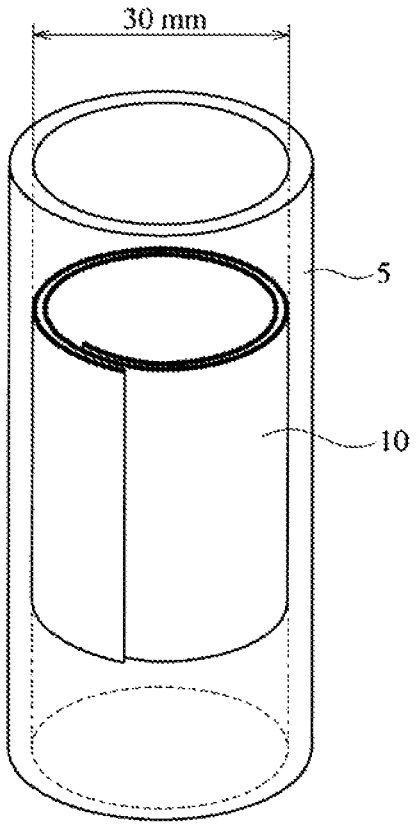
FIG. 3 is a perspective view showing a wound amorphous alloy ribbon piece inserted into a cylindrical quartz pipe.

How much internal stress is removed by a heat treatment is expressed by a stress relief degree. As shown in FIG. 3, the measurement of the stress relief degree is carried out by inserting a wound amorphous alloy ribbon piece 10 of 90 mm in length into a cylindrical quartz pipe 5 having an inner diameter of 25 mm, heat-treating the amorphous alloy ribbon piece 10 at 360° C. for 120 minutes, cooling the cylindrical quartz pipe 5 to room temperature, taking the heat-treated amorphous alloy ribbon piece 10 out of the cylindrical quartz pipe 5, and measuring the outer diameter of the heat-treated, wound, amorphous alloy ribbon piece 10 in an unconstrained state, thereby determining the stress relief degree by the equation of stress relief degree=[25 (mm)/outer diameter (mm) of heat-treated, wound, amorphous alloy ribbon piece]×100(%). When the outer diameter of the heat-treated, wound, amorphous alloy ribbon piece 10 is equal to 25 mm, the inner diameter of the cylindrical quartz pipe 5, the stress relief degree is 100%, meaning that there is no spring-back.

The Fe—Si—B—C-based amorphous alloy ribbon of the present invention is characterized by having a stress relief degree of 92% or more. Because of as high a stress relief degree as 92% or more, a transformer core constituted by a bent laminate of the Fe—Si—B—C-based amorphous alloy ribbon pieces and subjected to a heat treatment for stress relief has high saturation magnetization with low core loss and exciting power. The preferred stress relief degree of the Fe—Si—B—C-based amorphous alloy ribbon is 94% or more.

[2] Production Method of Amorphous Alloy Ribbon

The Fe—Si—B—C-based amorphous alloy ribbon of the present invention can be produced by a quenching method, typically a single-roll quenching method. The single-roll quenching method comprises (1) ejecting an alloy melt having the above composition at 1250-1400° C. from a nozzle onto a rotating cooling roll, and (2) stripping the quenched alloy ribbon from the roll surface by blowing an inert gas into a gap between the alloy ribbon and the roll.

[3] Transformer Core

The transformer core formed by the Fe—Si—B—C-based amorphous alloy ribbon of the present invention is shown in FIGS. 2(*a*) and 2(*b*). The transformer core 1 is constituted by plural amorphous alloy ribbon pieces 1*a*, whose lengths are gradually increasing as they near the surface. Both end portions of each bent amorphous alloy ribbon piece 1*a* are alternately overlapped to form a cylindrical shape. As a result, the transformer core 1 has an overlapped portion 2.

The transformer core 1 has a thickness T, which may usually be 10-200 mm, and a width W, which may usually be 100-260 mm. Each overlapped portion 2 of the transformer core 1 has a length Lo, which may usually be 30-500 mm, and a thickness To, which may usually be 10-400 mm, and a thickness T, which may usually be 10-300 mm, and a length A, which may usually be 150-1000 mm.

Because both ends of the Fe—Si—B—C-based amorphous alloy ribbon pieces 1*a* are bent with as small a radius of curvature as 2-10 mm, preferably 5-7 mm, a strong internal stress is generated in the core 1. Accordingly, the core 1 is heat-treated at 300-400° C. for 30-360 minutes to remove internal stress.

The present invention will be explained in more detail referring to Examples below without intention of restricting the present invention thereto.

Examples 1-4, and Comparative Examples 1-4

Each alloy melt at 1,350° C., which had the composition shown in Table 1, was ejected onto a rotating cooling roll, and the resultant amorphous alloy ribbon was stripped from the cooling roll by blowing a carbon dioxide gas into a gap between the amorphous alloy ribbon and the cooling roll. Each amorphous alloy ribbon shown in Table 1 had a thickness ranging from about 20 μm to about 35 μm and a width of 50.8 mm.

Each amorphous alloy ribbon was measured with respect to a Qurie temperature, a crystallization start temperature, the number of brittle fracture, an embrittlement start thickness, a stress relief degree, and core loss, by the methods described below.

(1) Qurie Temperature

The Qurie temperature of each amorphous alloy ribbon was measured by differential scanning calorimetry (DSC) with a heating rate of 20° C. per minute.

(2) Crystallization Start Temperature

The crystallization start temperature of each amorphous alloy ribbon was measured by DSC with a heating rate of 20° C. per minute.

(3) Number of Brittle Fracture

Figure 4A:
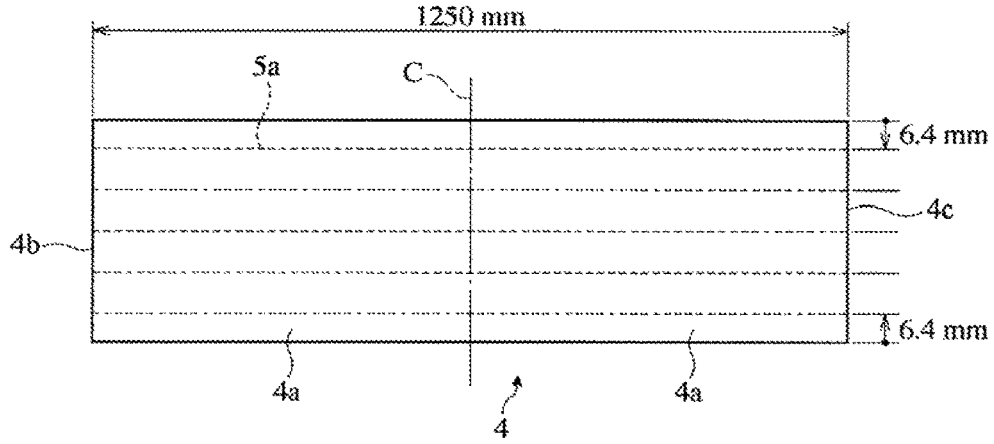
FIG. 4(*a*) is a plan view showing a test piece cut out of each amorphous alloy ribbon of Examples 1-4 and Comparative Examples 1-4.
Figure 4B:
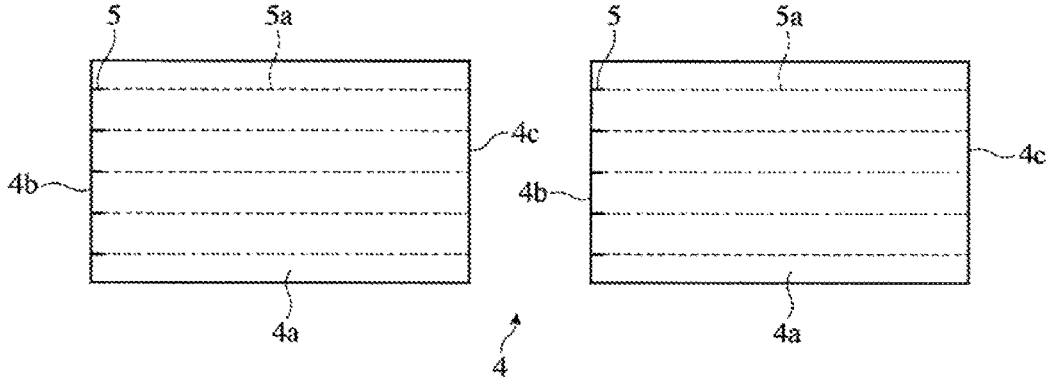
Figure 4C:
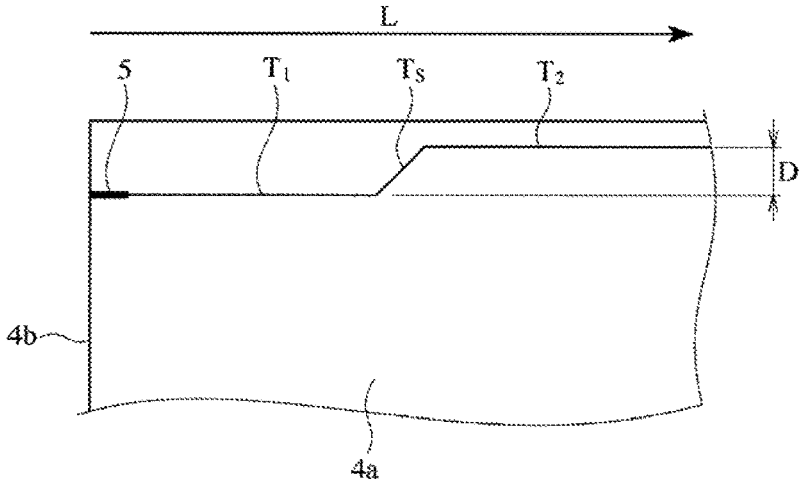
Figure 5A:
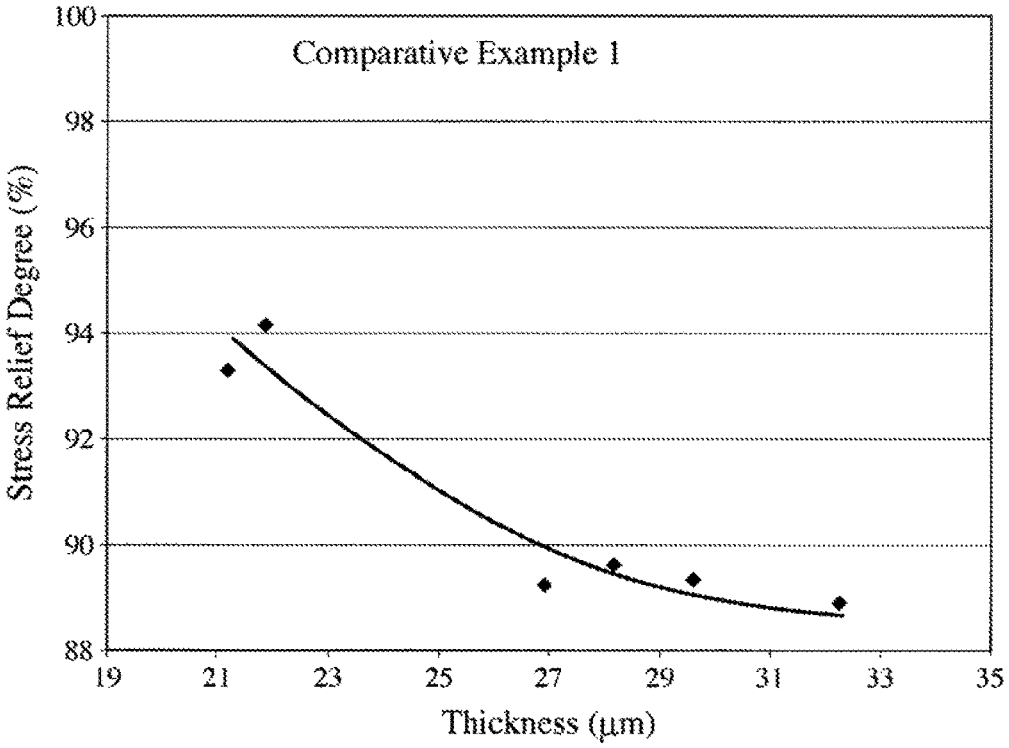
FIG. 5(*a*) is a graph showing the relation between stress relief degree and the thickness of the amorphous alloy ribbon in Comparative Example 1.
Figure 5B:
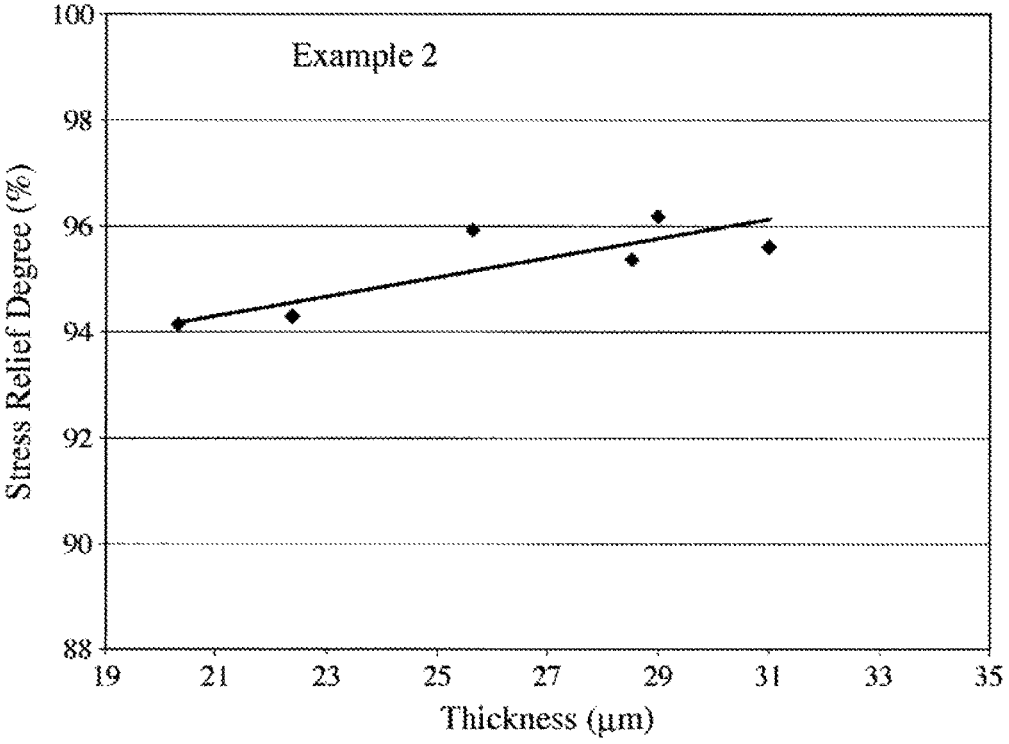
Figure 5C:
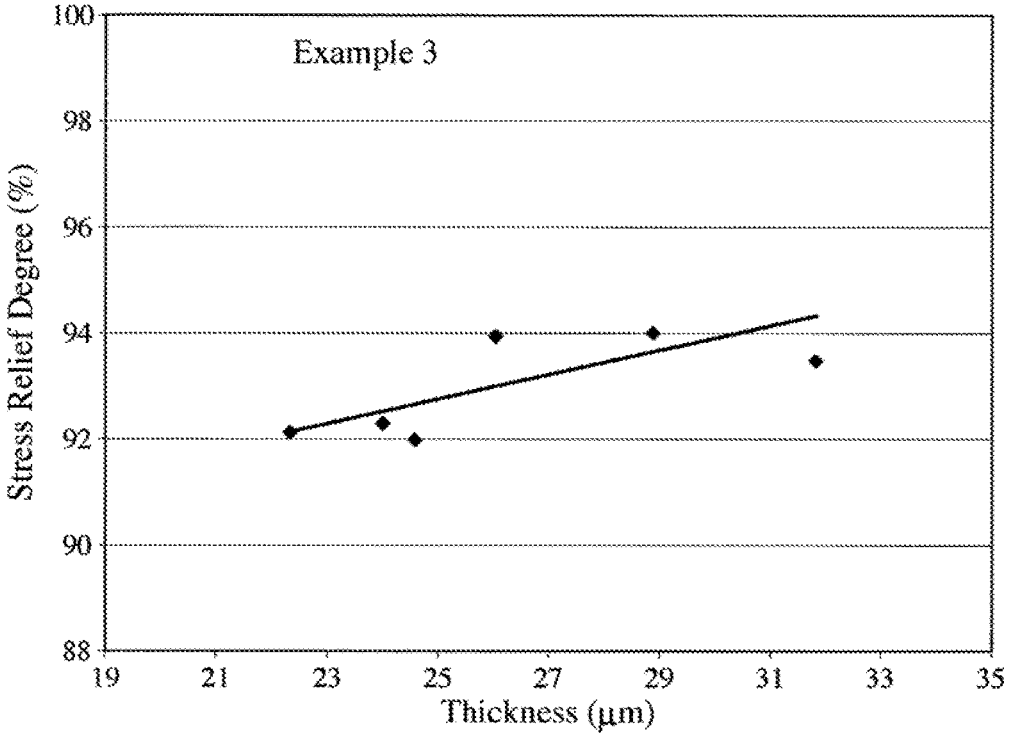
Figure 5D:
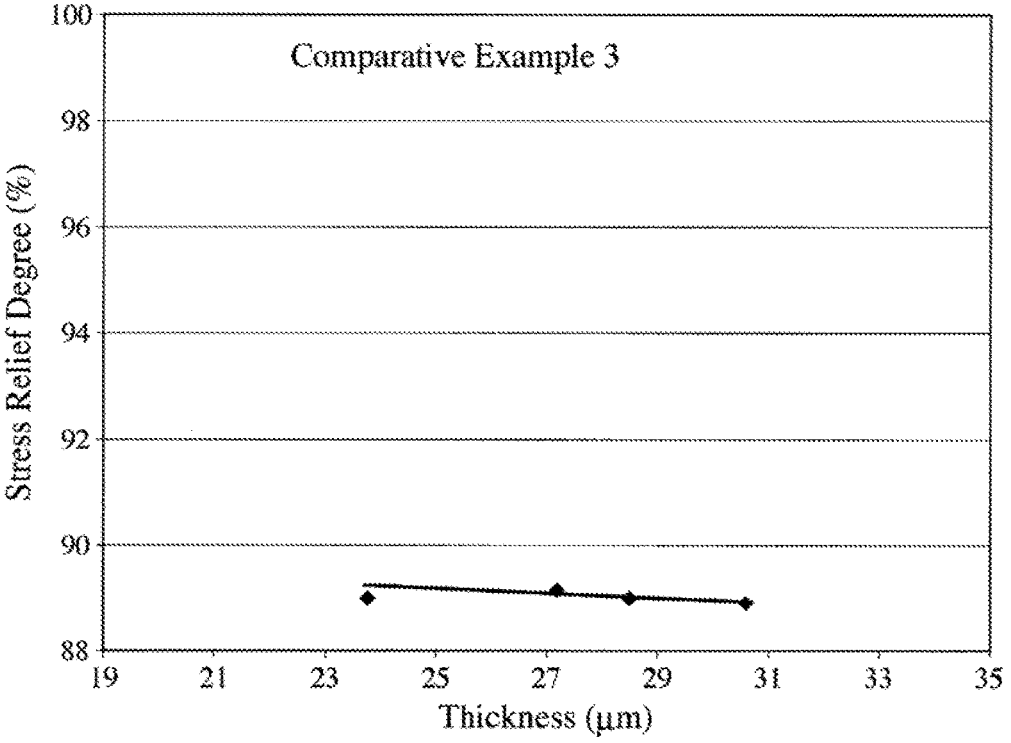
Figure 6A:
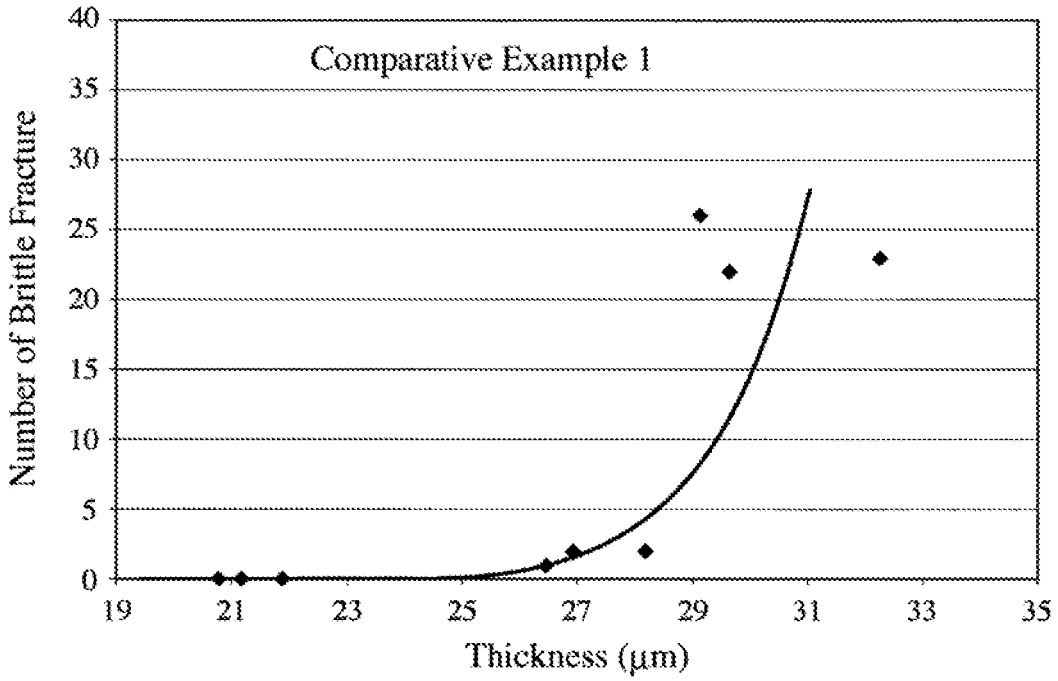
FIG. 6(*a*) is a graph showing the relation between the number of brittle fracture and the thickness of the amorphous alloy ribbon in Comparative Example 1.
Figure 6B:
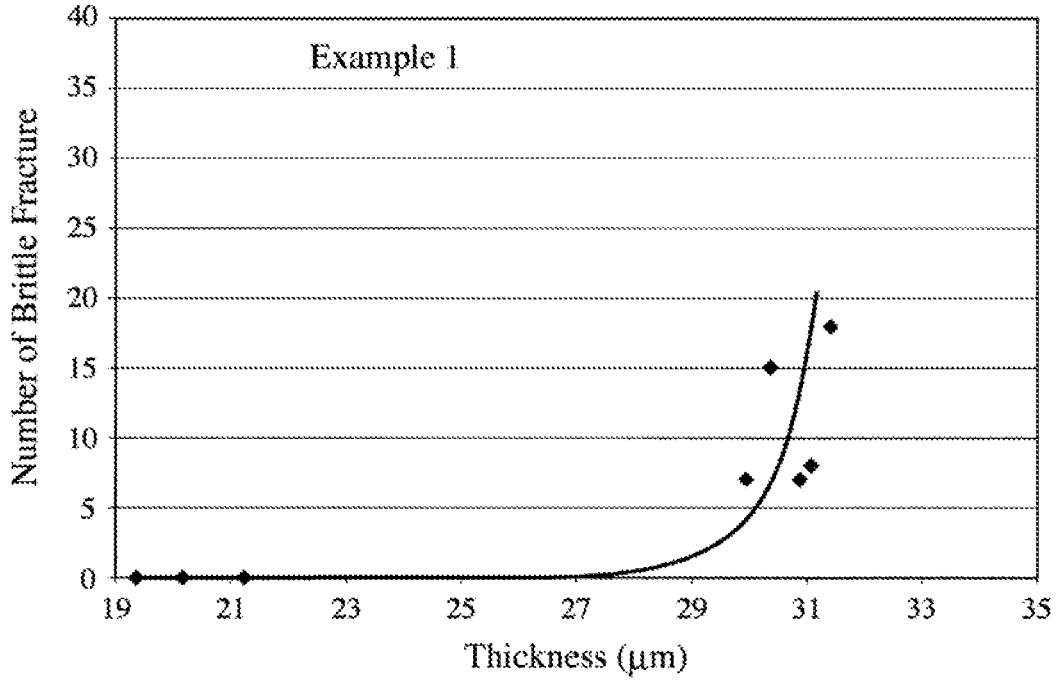
Figure 6C:
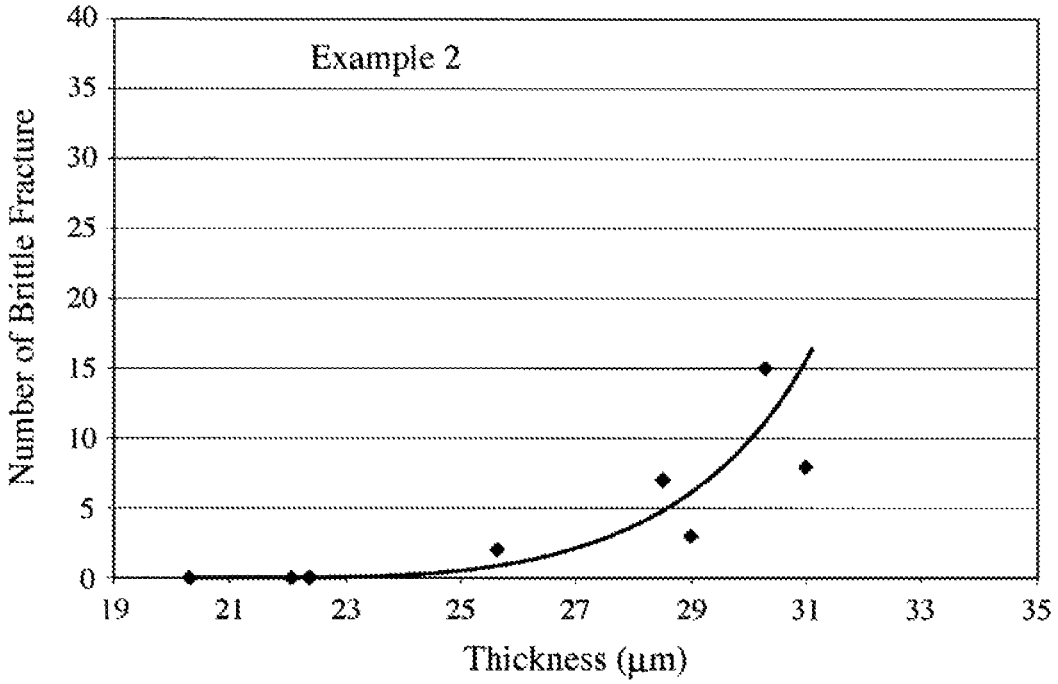
Figure 6D:
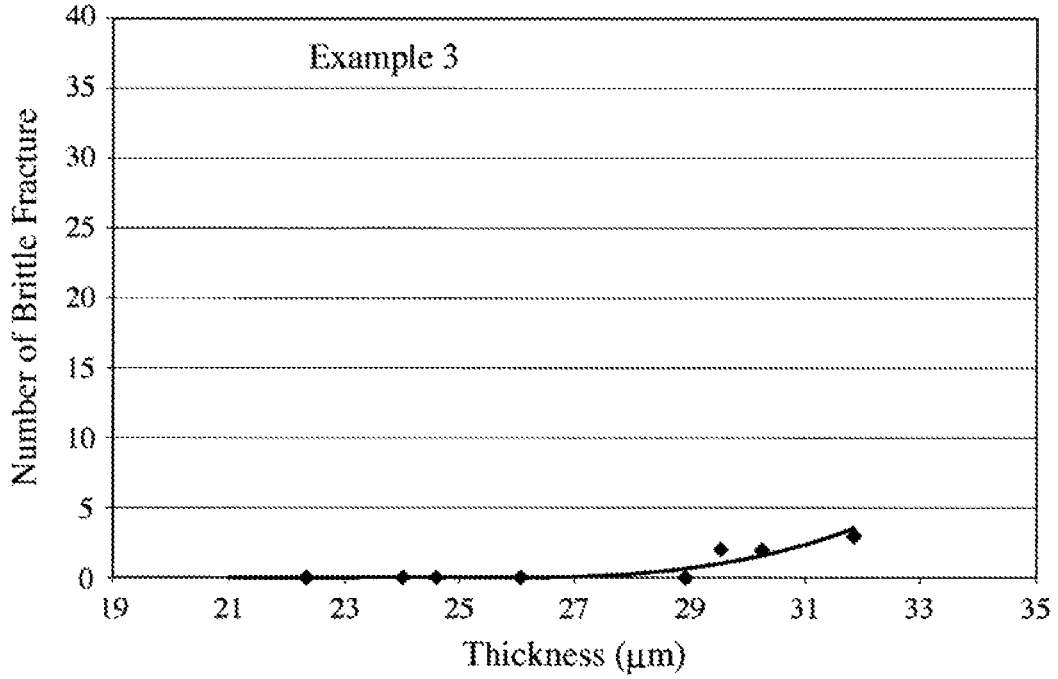
Figure 6E:
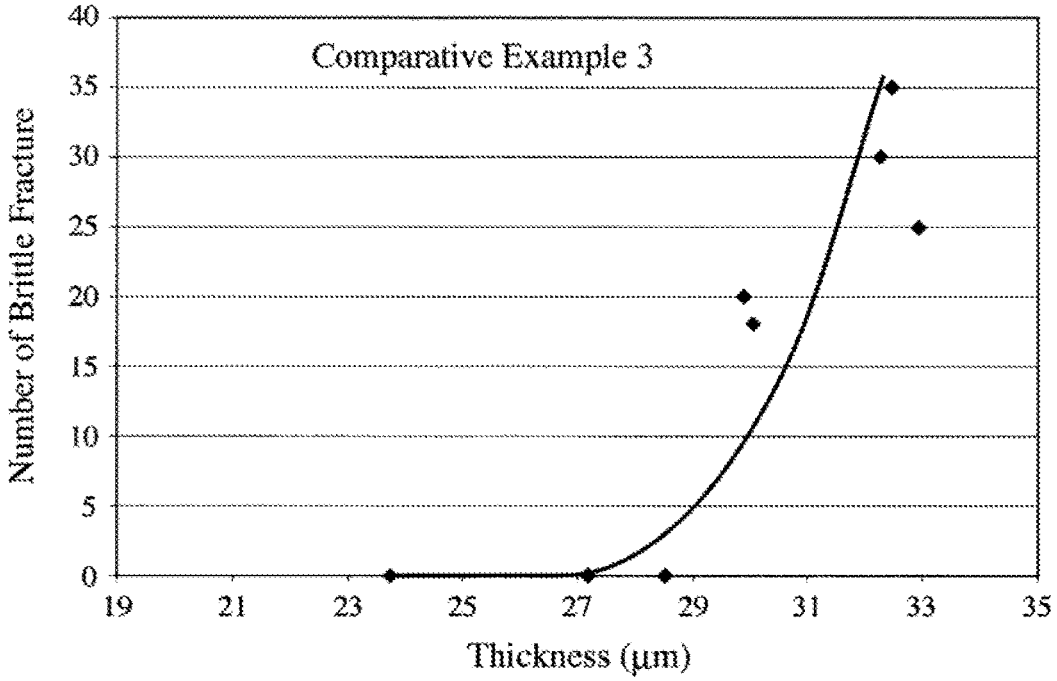
Figure 6F:
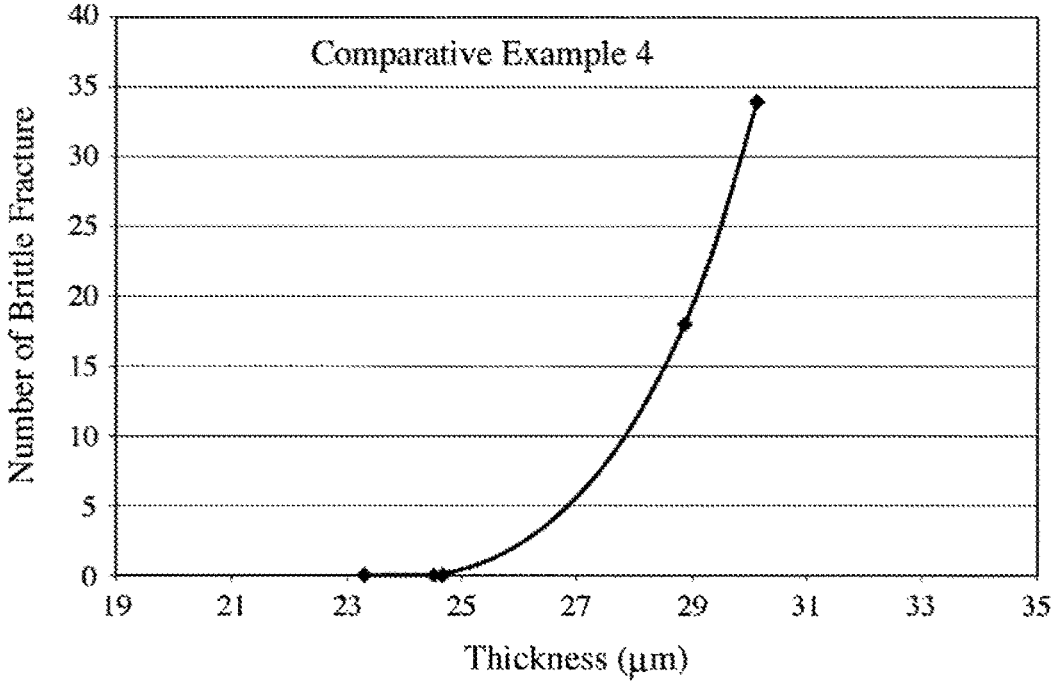

A test piece 4 shown in FIG. 4(*a*), which was as long as 1250 mm, was cut out of each amorphous alloy ribbon of Examples 1-4 and Comparative Examples 1-4, and equally divided to two test pieces 4*a*, 4*a* shown in FIG. 4(*b*) along a transverse centerline C. At one longitudinal end 4*b*, 4*b* of each test piece 4*a*, 4*a*, five notches 5 for tearing start were formed with equal intervals in a region within 6.4 mm from both transverse edges of the test piece 4*a*, 4*a*. Accordingly, 10 notches 5 in total were formed in both test pieces 4*a*, 4*a*.

A shearing force was applied to each notch 5 to tear each test piece 4*a*, 4*a* longitudinally to the other longitudinal end 4*c*. When fracture occurred during tearing in a longitudinal direction shown by the arrow L, a step Ts was formed in a longitudinal tearing line $T_1$ as shown in FIG. 4(*c*), and the next longitudinal tearing line $T_2$ started from the step Ts. Thus, brittle fracture occurred at one or more steps in each longitudinal tearing. When a transverse distance D between the longitudinal tearing line $T_1$ and the next longitudinal tearing line $T_2$ was 6 mm or more, it was judged that brittle fracture occurred. This judgment was conducted on all tearing lines starting from 10 notches 5, to determine the total number of fracture, which was regarded as the number of brittle fracture.

(4) Embrittlement Start Thickness

The embrittlement start thickness of each amorphous alloy ribbon was expressed by the thickness at which the number of brittle fracture reached 3, when the thickness of the amorphous alloy ribbon was increased stepwise.

(5) Stress Relief Degree

An amorphous alloy ribbon piece as long as 90 mm was cut out of each amorphous alloy ribbon as thick as 26-27 μm, wound to a cylindrical shape, inserted into a cylindrical quartz pipe shown in FIG. 3 and having an inner diameter of 25 mm, and heat-treated at 360° C. for 120 minutes. After the heat treatment, the wound amorphous alloy ribbon was taken out of the cylindrical quartz pipe, and left free such that its outer diameter expanded due to springback in an unconstrained state. The stress relief degree was determined from the measured outer diameter by the equation:

Stress relief degree=[25 (mm)/measured outer diameter (mm)]×100(%).

(6) Core Loss and Exciting Power

Each amorphous alloy ribbon was wound to a transformer core, and its core loss and exciting power were measured under sinusoidal excitation with primary and secondary windings.

The Qurie temperature, crystallization start temperature, embrittlement start thickness and stress relief degree of Examples 1-4 and Comparative Examples 1-4 are shown in Table 2. The relation between the stress relief degree and the thickness of the amorphous alloy ribbon in each of Examples 2 and 3 and Comparative Examples 1 and 3 is shown in FIGS. 5(*a*) to 5(*d*). The relation between the number of brittle fracture and the thickness of the amorphous alloy ribbon in each of Examples 1-3 and Comparative Examples 1, 3 and 4 is shown in FIGS. 6(*a*) to 6(*f*).

TABLE 1

| No. | Alloy Composition (atomic %) | | | |
|---|---|---|---|---|
| | Fe | B | Si | C[1] |
| Comparative Example 1 | 79.59 | 11.29 | 9.12 | 0.40 |
| Comparative Example 2 | 79.24 | 11.39 | 9.37 | 0.36 |

TABLE 1-continued

| No. | Alloy Composition (atomic %) | | | |
|---|---|---|---|---|
| | Fe | B | Si | C[1] |
| Example 1 | 80.27 | 11.76 | 7.97 | 0.33 |
| Example 2 | 80.11 | 12.22 | 7.67 | 0.33 |
| Example 3 | 80.46 | 12.50 | 7.05 | 0.33 |
| Example 4 | 80.23 | 12.91 | 6.86 | 0.35 |
| Comparative Example 3 | 80.89 | 13.34 | 5.77 | 0.33 |
| Comparative Example 4 | 80.45 | 17.58 | 1.97 | 0.33 |

Note:
[1]Atomic % per 100 atomic % of the total amount of Fe, B and Si.

TABLE 2

| No. | Qurie Temperature (° C.) | Crystallization Start Temperature (° C.) | Embrittlement Start Thickness (μm) | Stress Relief Degree[1] (%) |
|---|---|---|---|---|
| Comparative Example 1 | 404 | 515 | 26 | 90 |
| Comparative Example 2 | 405 | 515 | 26 | 91 |
| Example 1 | 397 | 510 | 26 | 94 |
| Example 2 | 396 | 511 | 26 | 95 |
| Example 3 | 387 | 505 | 29 | 93 |
| Example 4 | 392 | 512 | 28 | 93 |
| Comparative Example 3 | 382 | 507 | 29 | 89 |
| Comparative Example 4 | 387 | 495 | 26 | 89 |

Note:
[1]Measured on the ribbons as thick as 26-27 μm.

As is clear from Tables 1 and 2, the Fe—Si—B—C-based amorphous alloy ribbons of Examples 1-4 had higher stress relief degrees than those of Comparative Examples 1-4, though they were not substantially different from each other with respect to a Qurie temperature, a crystallization start temperature and a embrittlement start thickness.

The comparison of FIGS. 5(*a*) to 5(*d*) indicates that when the amorphous alloy ribbon was as thick as 27 μm or more, the stress relief degree was higher than 92% in Examples 2 and 3 and lower than 90% in Comparative Examples 1 and 3. This verifies that to have as high a stress relief degree as 92% or more, the composition requirements of the present invention should be met.

The comparison of FIGS. 6(*a*) to 6(*f*) indicates that when the amorphous alloy ribbon was as thick as 27 μm or more, the number of brittle fracture was as small as 20 or less in Examples 1-3 and as large as more than 25 in Comparative Examples 1, 3 and 4.

Transformer cores shown in FIGS. 2(*a*) and 2(*b*) were formed by the amorphous alloy ribbons of Comparative Example 1 as thick as 23 μm, and two amorphous alloy ribbons of Example 3 as thick as 23 μm and 26 μm, respectively, and annealed at temperatures ranging from 330° C. to 370° C. for 1 hour in a DC magnetic field of 2,000 A/m in a core circumference direction. In FIG. 2(*a*), R represents the minimum radius of curvature among those of curved corners. Each transformer core had the following size and weight:

A 235 mm,
$L_0$ 110 mm,
T 75 mm,
W 142 mm, $T_0$ 94 mm,

R 6.5 mm, and

Weight 84 kg.

Each transformer core was magnetized at 1.3 T and 50 Hz to measure core loss and exciting power. The results are shown in Table 3. It is clear from Table 3 that exciting power was lower in Example 3 than in Comparative Example 1 at all the annealing temperatures, though there were no significant differences in core loss between Example 3 and Comparative Example 1.

TABLE 3

| No. | Ribbon Thickness (μm) | Annealing Temperature (° C.) | Core Loss(1) (W/kg) | Exciting Power(1) (VA/kg) |
|---|---|---|---|---|
| Comparative Example 1 | 23 | 330 | 0.168 | 0.647 |
| | | 340 | 0.152 | 0.378 |
| | | 350 | 0.147 | 0.270 |
| | | 360 | 0.150 | 0.247 |
| | | 370 | 0.157 | 0.233 |
| Example 3 | 23 | 330 | 0.153 | 0.285 |
| | | 340 | 0.148 | 0.228 |
| | | 350 | 0.148 | 0.210 |
| | | 360 | 0.155 | 0.206 |
| | | 370 | 0.179 | 0.224 |
| | 26 | 330 | 0.151 | 0.243 |
| | | 340 | 0.149 | 0.210 |
| | | 350 | 0.151 | 0.207 |
| | | 360 | 0.165 | 0.208 |
| | | 370 | 0.202 | 0.243 |

Note:
(1)Measured at 1.3 T and 50 Hz.

Although the embodiments of the present invention have been described above, it would be appreciated by those skilled in the art that modifications may be made in these embodiments without departing from the principles and spirit of the present invention.

Effects of the Invention

Because the Fe—Si—B—C-based amorphous alloy ribbon of the present invention can exhibit as large a stress relief degree as 92% or more when heat-treated in a wound or curved state, a magnetic core formed thereby does not have large internal stress after a heat treatment. As a result, it exhibits high saturation magnetization with small exciting power and core loss. The Fe—Si—B—C-based amorphous alloy ribbon of the present invention having such features is suitable for transformer cores.

What is claimed is:

1. An Fe—Si—B—C-based amorphous alloy ribbon comprising:

an amorphous alloy having a composition comprising 80.0-80.7 atomic % of Fe, 6.1-7.99 atomic % of Si, and 11.5-13.2 atomic % of B, the total amount of Fe, Si and B constituting 100 atomic % of Fe, Si and B, and the composition further comprising an amount of C in an atomic ratio of 0.2-0.45 atomic % of C per 100 atomic % of the total amount of Fe, Si and B, except for inevitable impurities, wherein the composition is represented by the following formula:

$(FeSiB)_{100}C_{0.2\text{-}0.45}$ (atomic %), except for the inevitable impurities, and wherein the Fe—Si—B—C-based amorphous alloy ribbon has a stress relief degree of 92% or more.

2. The Fe—Si—B—C-based amorphous alloy ribbon according to claim 1, wherein the Fe—Si—B—C-based amorphous alloy ribbon has a thickness of 20-30 μm.

3. The Fe—Si—B—C-based amorphous alloy ribbon according to claim 1, wherein the Fe—Si—B—C-based amorphous alloy ribbon has a thickness of 22-27 μm.

4. The Fe—Si—B—C-based amorphous alloy ribbon according to claim 1, wherein the Fe—Si—B—C-based amorphous alloy ribbon has a width of 100 mm or more.

5. A transformer core formed by a laminate of an Fe—Si—B—C-based amorphous alloy ribbon having a composition comprising 80.0-80.7 atomic % of Fe, 6.1-7.99 atomic % of Si, and 11.5-13.2 atomic % of B, the total amount of Fe, Si and B constituting 100 atomic % of Fe, Si and B, and the composition further comprising an amount of C in an atomic ratio of 0.2-0.45 atomic % of C per 100 atomic % of the total amount of Fe, Si and B, except for inevitable impurities, wherein the composition is represented by the following formula:

$(FeSiB)_{100}C_{0.2\text{-}0.45}$ (atomic %), except for the inevitable impurities, and wherein the Fe—Si—B—C-based amorphous alloy ribbon has a stress relief degree of 92% or more.

6. The transformer core according to claim 5, wherein the Fe—Si—B—C-based amorphous alloy ribbon has a thickness of 20-30 μm.

7. The transformer core according to claim 5, wherein the Fe—Si—B—C-based amorphous alloy ribbon has a thickness of 22-27 μm.

8. The transformer core according to claim 5, wherein the Fe—Si—B—C-based amorphous alloy ribbon has a width of 100 mm or more.

9. The transformer core according to claim 5, wherein the Fe—Si—B—C-based amorphous alloy ribbon has curved corners each having a radius of curvature of 2-10 mm.

10. The transformer core according to claim 5, wherein the Fe—Si—B—C-based amorphous alloy ribbon has core loss of less than 0.20 W/kg at 50 Hz and 1.3 T.

* * * * *